US006163909A

United States Patent [19]

Lin

[11] Patent Number: 6,163,909

[45] Date of Patent: Dec. 26, 2000

[54] PNEUMATIC MATTRESS ASSEMBLY

[76] Inventor: Jeng Ming Lin, No. 258, Gou Chien Lane, Lu Gang Town, Chang Hua Hsien, Taiwan

[21] Appl. No.: 09/346,668

[22] Filed: Jul. 2, 1999

[51] Int. Cl.[7] ..... A47C 27/10

[52] U.S. Cl. ..... 5/713; 5/710; 5/723

[58] Field of Search ..... 5/713, 710, 706, 5/723, 737, 738, 655.3, 496

[56] References Cited

U.S. PATENT DOCUMENTS

| | | | |
|---|---|---|---|
| 3,678,520 | 7/1972 | Evans | 5/713 |
| 4,163,297 | 8/1979 | Neumark | 5/723 X |
| 4,382,306 | 5/1983 | Lickert | 5/710 |
| 4,489,452 | 12/1984 | Lickert | 5/710 |
| 4,722,105 | 2/1988 | Douglas | 5/713 |
| 4,745,647 | 5/1988 | Goodwin | 5/713 |
| 4,768,249 | 9/1988 | Goodwin | 5/713 |
| 4,944,060 | 7/1990 | Peery et al. | 5/737 X |
| 5,003,654 | 4/1991 | Vrzalik | 5/713 |
| 5,035,014 | 7/1991 | Blanchard | 5/739 X |
| 5,062,171 | 11/1991 | Vrzalik | 5/713 |
| 5,142,719 | 9/1992 | Vrzalik | 5/710 X |
| 5,152,021 | 10/1992 | Vrzalik | 5/713 X |
| 5,267,364 | 12/1993 | Volk | 5/713 |
| 5,323,500 | 6/1994 | Roe et al. | 5/713 X |
| 5,421,044 | 6/1995 | Steensen | 5/713 X |
| 5,584,085 | 12/1996 | Banko | 5/710 |
| 5,634,225 | 6/1997 | Miller, Sr. et al. | 5/710 |
| 5,647,079 | 7/1997 | Hakamiun et al. | 5/723 X |
| 5,745,941 | 5/1998 | Miller, Sr. | 5/710 |
| 5,966,762 | 10/1999 | Wu | 5/713 X |
| 5,991,949 | 11/1999 | Miller, Sr. et al. | 5/713 X |

*Primary Examiner*—Terry Lee Melius
*Assistant Examiner*—Robert G. Santos
*Attorney, Agent, or Firm*—Charles E. Baxley

[57] ABSTRACT

A pneumatic mattress includes a number of air envelopes and a base pad having two side portions secured to the air envelopes with a number of fastener nuts and fasteners which may solidly secure the air envelopes to the base pad. A number of couplers are engaged between the side portions of the base pad and the fasteners for reinforcing purposes. An air pump is coupled to the air envelopes with a number of air valves and one or more hoses. A relief valve is engaged in the hose for discharging the air in the air envelopes quickly.

5 Claims, 4 Drawing Sheets

PNEUMATIC MATTRESS ASSEMBLY

BACKGROUND OF THE INVENTION

1. Field of the Invention

The present invention relates to a mattress, and more particularly to a pneumatic mattress for therapy purposes.

2. Description of the Prior Art

Typical pneumatic mattresses comprise a number of air bags or envelopes disposed between a cover and a base. However, the air bags and the cover and the base may not be easily secured together. In addition, the air received in the pneumatic mattress may not be easily and quickly discharged.

The present invention has arisen to mitigate and/or obviate the afore-described disadvantages of the conventional pneumatic mattresses.

SUMMARY OF THE INVENTION

The primary objective of the present invention is to provide a pneumatic mattress having a configuration that may be easily and quickly assembled and having a relief valve for quickly discharging the air received in the pneumatic mattress.

In accordance with one aspect of the invention, there is provided a pneumatic mattress comprising a base pad including two side portions extended upward from the base pad, a plurality of air envelopes disposed on the base pad, and including two sides, and including a fastener nut secured to the sides of the air envelopes thereof and each having an inner thread formed therein, and a plurality of fasteners engaged through the side portions of the base pad and threaded with the inner threads of the fastener nuts of the air envelopes for solidly securing the air envelopes to the base pad.

A number of couplers are engaged with the side portions of the base pad and aligned with the fastener nuts respectively and each includes an aperture formed therein for receiving the fasteners, the side portions of the base pad are engaged between the fastener nuts and the couplers.

A pump device is further provided for pumping the air envelopes and includes a plurality of air valves couples to the air envelopes respectively, and an air pump coupled to the air valves for supplying air to the air envelopes.

A cover sheet is engaged on the air envelopes and includes two side portions each having a plurality of retainers secured thereon, the retainers each includes a recess formed therein, the couplers each includes an annular protrusion extended therefrom for engaging into the recesses of the retainers and for securing the cover sheet to the base pad.

A relief valve is further engaged in the hose for discharging the air in the air envelopes and includes a housing having a bore formed therein and having at least one pair of studs oppositely and laterally extended outward therefrom and coupled to the hose, and a plug having at least one groove formed therein for communicating the pair of studs with each other. The plug includes a head formed thereon and defined by an annular recess. A spring-biased projection is engaged with the annular recess of the plug for retaining the plug in the housing.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
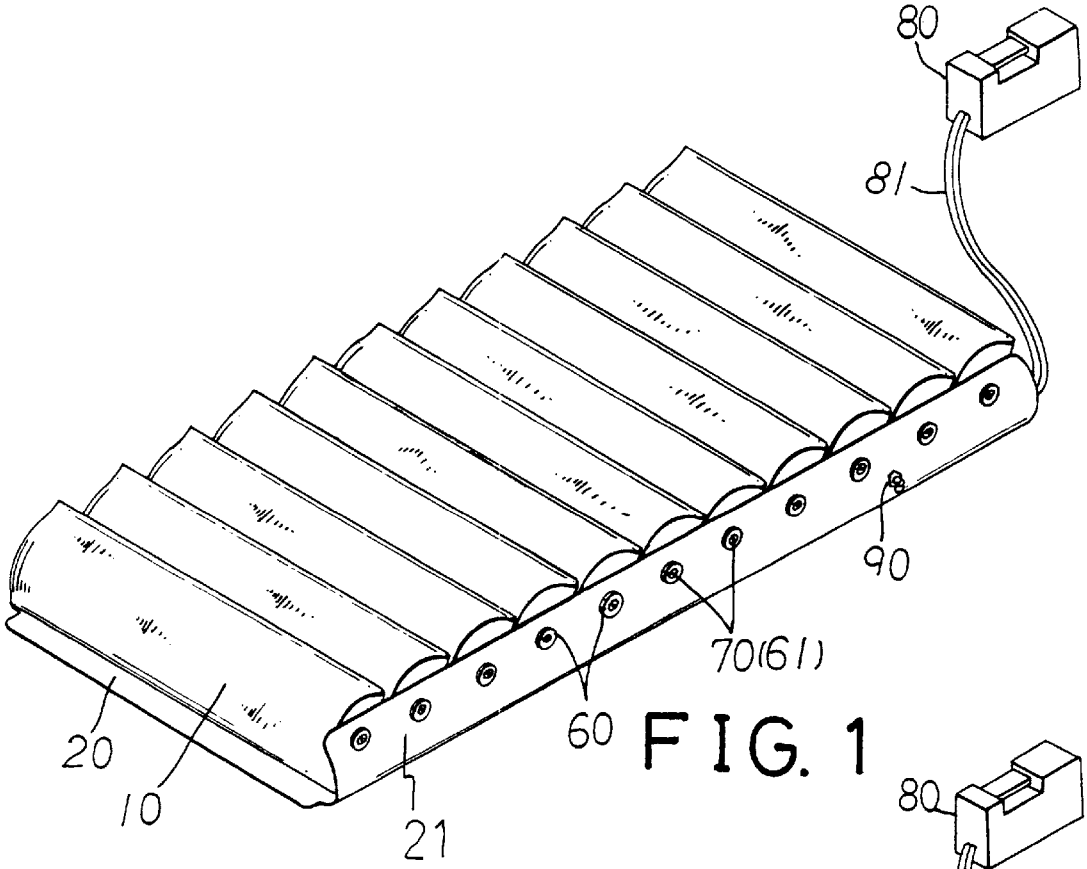
FIG. 1 is a perspective view of a pneumatic mattress in accordance with the present invention.

Referring to the drawings, and initially to FIGS. 1–4, a pneumatic mattress in accordance with the present invention comprises a base sheet or base pad 10, and a number of air bags or air envelopes 20 disposed on the base pad 10 side by side. The air envelopes 20 each includes two sides each having a fastener nut 50 secured thereon by such as the adhesive materials or by welding process. The fastener nuts 50 each includes an inner thread 51 formed therein for threading with a fastener 70. The base pad 10 includes two side portions 21 extended or folded upward to engage with the side portions of the air envelopes 20. A number of couplers 60 are engaged with the side portions 21 of the base pad 10 and are aligned with the fastener nuts 50 respectively and each includes an aperture 61, particularly the countersunk aperture formed therein for receiving the fasteners 70 which may thus be used to secure the air envelopes 20 together and to the base pad 10. The couplers 60 are provided for reinforcing purposes. An air pump 80 is coupled to the air envelopes 20 with one or more hoses 81 and a number of air valves 83.

Figure 2:
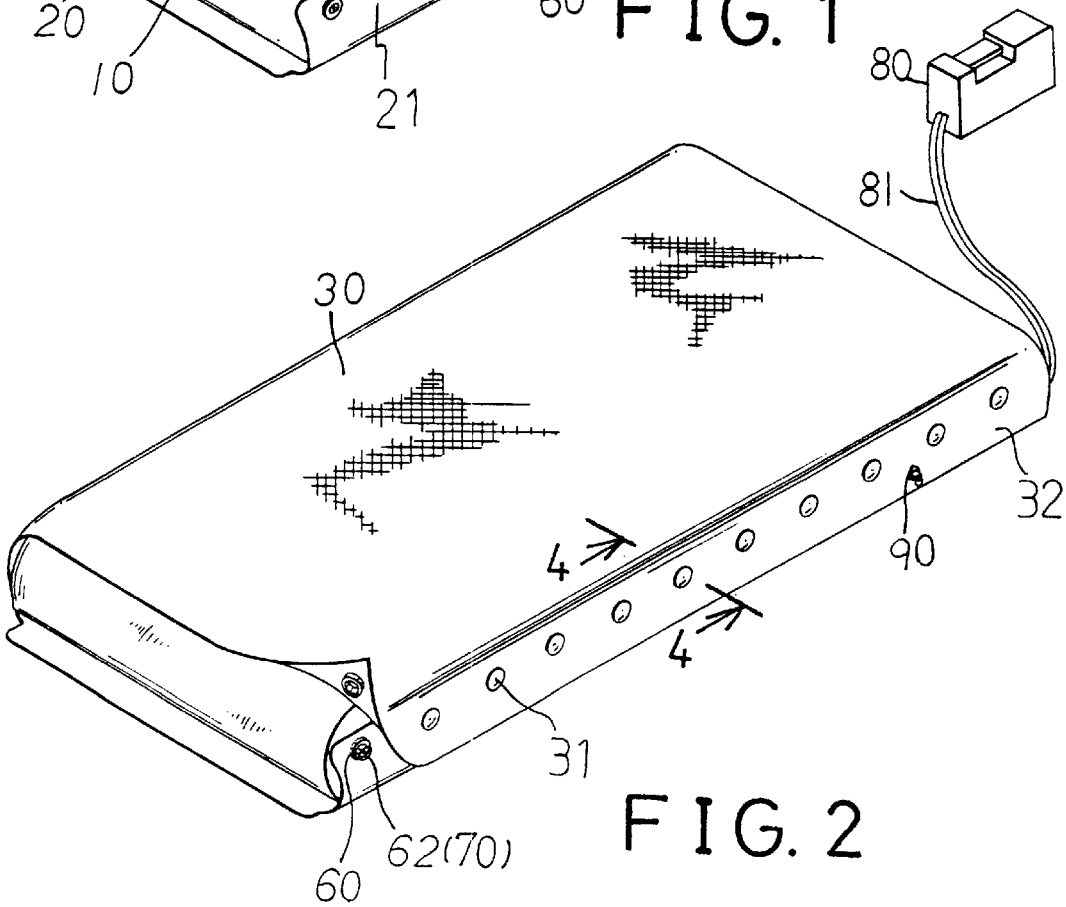
FIG. 2 is a perspective view of the pneumatic mattress which includes a cover attached thereon.
Figure 3:
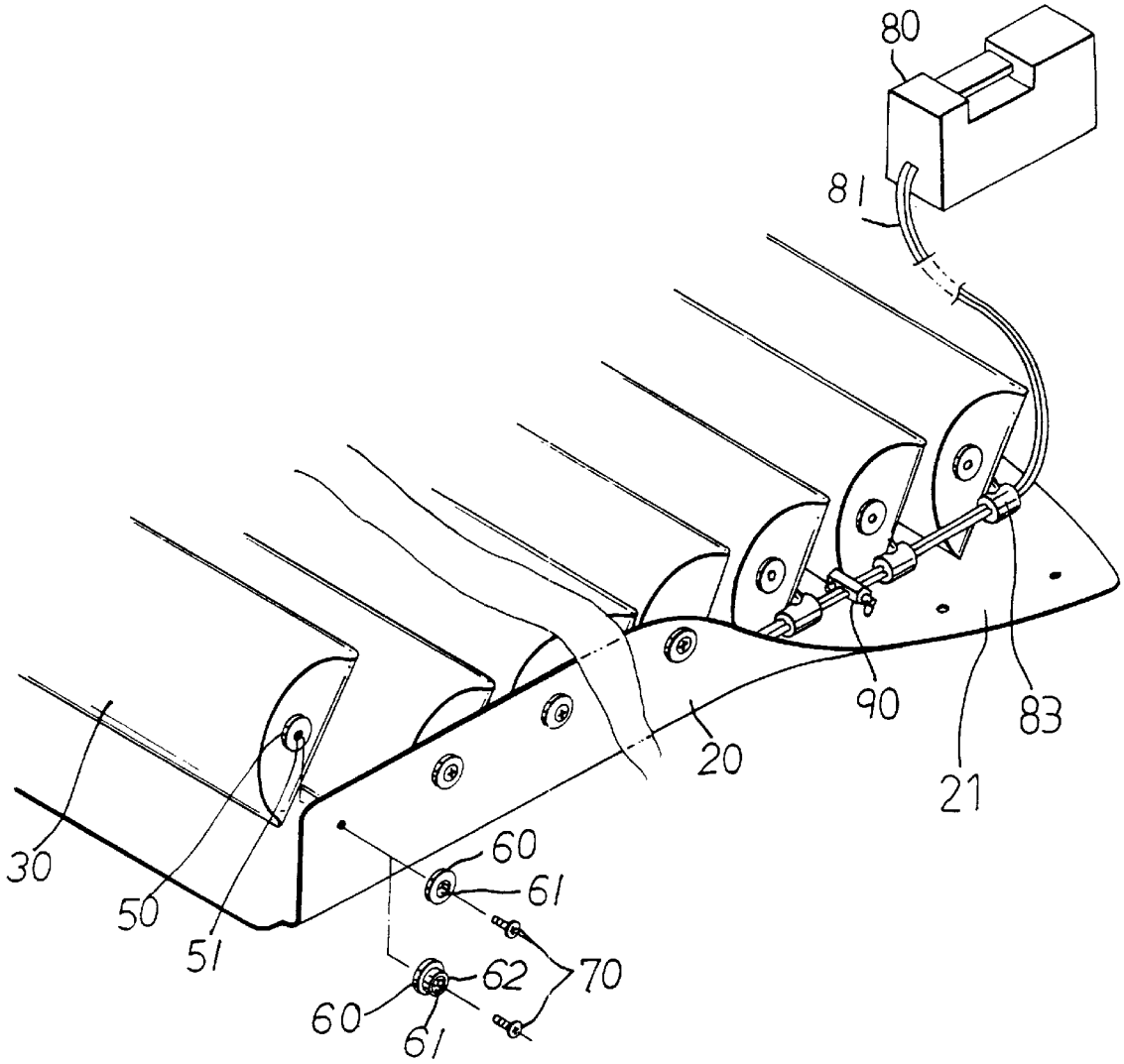
FIG. 3 is a partial exploded view of the pneumatic mattress.

As shown in FIGS. 2 and 3, a cover sheet 30 may further be provided and secured on top of the air envelopes 20 and includes a number of retainers or fasteners 31 secured to the side portions 32 thereof. When the cover sheet 30 is provided and is required to be secured on top of the air envelopes 20, the couplers 60 each includes an annular protrusion 62 extended therefrom for engaging into a recess 33 of the fastener 31 (FIG. 4) and for allowing the cover sheet 30 to be easily and quickly secured to the air envelopes 20 and the base pad 10.

Figure 5:
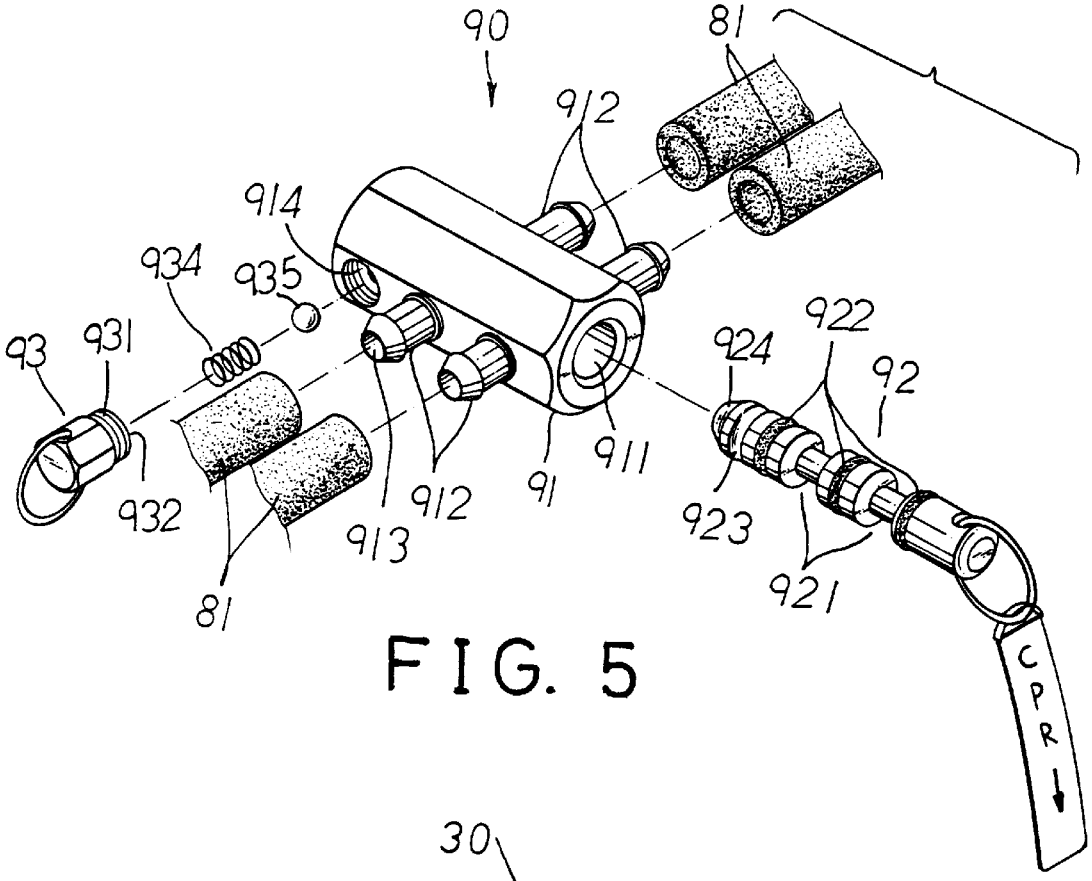
FIG. 5 is an exploded view of a relief valve for the pneumatic mattress.
Figure 4:
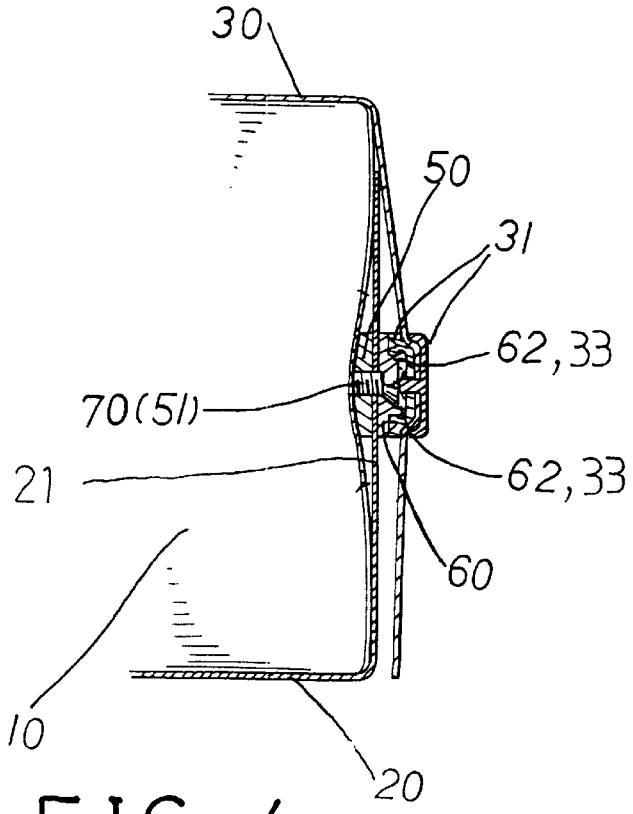
FIG. 4 is a cross sectional view taken along lines 4—4 of FIG. 2.
Figure 7:
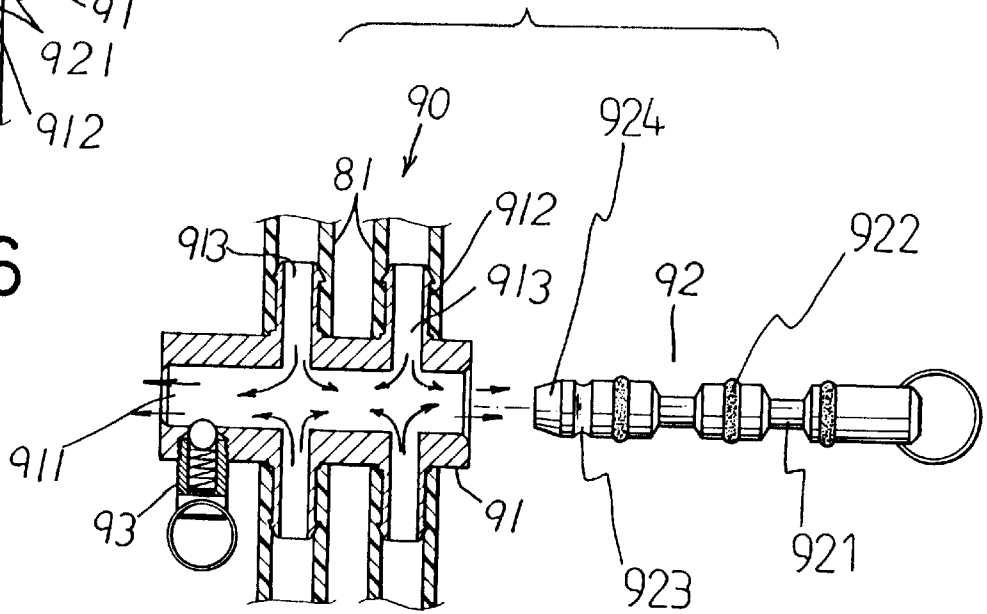
FIG. 7 is a cross sectional view illustrating the operation of the relief valve.
Figure 6:
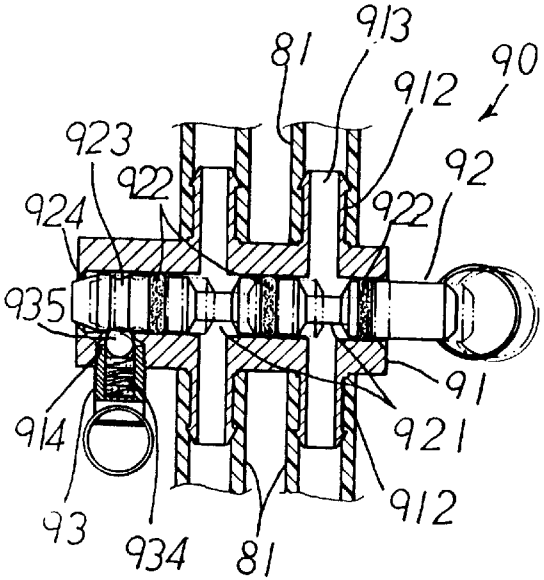
FIG. 6 is a cross sectional view of the relief valve.

Referring next to FIGS. 5–7, and again to FIGS. 1–3, a relief valve 90 is provided and coupled to the hose(s) 81 for easily and quickly discharging the air in the air envelopes 20. The relief valve 90 includes a housing 91 having a bore 911 formed therein for slidably receiving a plug 92 and having a screw hole 914 formed therein. The housing 91 includes one or more pairs of studs 912 oppositely and laterally extended outward therefrom and coupled to the hoses 81 and each having an aperture 913 communicating with the bore 911 of the housing 91 for allowing the air from the hoses 81 to flow into the housing 91. The plug 92 includes one or more grooves 921 formed therein for aligning with and for connecting the hoses 81 together and includes one or more sealing rings 922 engaged thereon for forming air tight sealings. The plug 92 includes a head 924 defined by an annular recess 923. A retainer 93 includes an outer thread 931 threaded with the screw hole 914 and includes a chamber 932 formed therein for receiving a spring 934 and a ball 935 which is partially spring-biased inward of the housing 91 to engage with the annular recess 923 of the plug 92 and to retain the plug 92 in the housing 91. The spring 934 and the ball 935 form a spring-biased projection for retaining the plug 02 in the housing 91.

In operation, as shown in FIG. 7, when the plug 92 is removed from the housing 91, the air in the hoses 81 and/or in the air envelopes 20 may be easily and quickly discharged via the relief valve 90. The air envelopes 20 may thus be easily and quickly flattened for emergency purposes, for example, or for folding and storing purposes.

It is to be noted that the air envelopes 20 may be expanded when the air is filled into the air envelopes. The fasteners 70 are engaged through the couplers 60 and engaged with the fasteners 50 such that the air envelopes 20 may be solidly secured to the base pad 10 and will not be easily disengaged from the base pad 10 when the air envelopes 20 are expanded. Alternatively, the air envelopes 20 may also be formed or coupled together by living hinges when the air envelopes 20 are formed by molding processes.

Accordingly, the pneumatic mattress in accordance with the present invention includes a configuration that may be easily and quickly assembled and having a relief valve for quickly discharging the air received in the pneumatic mattress. The mattress is particularly good for therapy purposes when the air envelopes are pumped separately or individually.

Although this invention has been described with a certain decree of particularity, it is to be understood that the present disclosure has been made by way of example only and that numerous changes in the detailed construction and the combination and arrangement of parts may he resorted to without departing from the spirit and scope of the invention as hereinafter claimed.

I claim:

1. A pneumatic mattress comprising:

a base pad including two side portions extended upward from said base pad, a plurality of air envelopes disposed on said base pad, and including two sides, and including a fastener nut secured to said sides of said air envelopes thereof and each having an inner thread formed therein, and a plurality of fasteners engaged through said side portions of said base pad and threaded with said inner threads of said fastener nuts of said air envelopes for solidly securing said air envelopes to said base pad.

2. The pneumatic mattress according to claim 1 further comprising a plurality of couplers engaged with said side portions of said base pad and aligned with said fastener nuts respectively and each including an aperture formed therein for receiving said fasteners, said side portions of said base pad being engaged between said fastener nuts and said couplers.

3. The pneumatic mattress according to claim 1 further comprising means for pumping said air envelopes.

4. The pneumatic mattress according to claim 3, wherein said pumping means includes a plurality of air valves coupled to said air envelopes respectively, and an air pump coupled to said air valves for supplying air to said air envelopes.

5. The pneumatic mattress according to claim 2 further comprising a cover sheet engaged on said air envelopes and including two side portions each having a plurality of retainers secured thereon, said retainers each including a recess formed therein, said couplers each including an annular protrusion extended therefrom for engaging into said recesses of said retainers and for securing said cover sheet to said base pad.

* * * * *